US005464522A

United States Patent [19]

MacEdmondson

[11] Patent Number: 5,464,522

[45] Date of Patent: Nov. 7, 1995

[54] ELECTROSTATIC OIL EMULSION TREATING METHOD AND APPARATUS

[76] Inventor: Jerry MacEdmondson, 510 Canal St., Newport Beach, Calif. 92663

[21] Appl. No.: 980,587

[22] Filed: Nov. 23, 1992

[51] Int. Cl.[6] ..... C10G 33/02

[52] U.S. Cl. ..... 204/302; 204/188; 204/307

[58] Field of Search ..... 204/186, 188, 204/302, 307, 308

[56] References Cited

U.S. PATENT DOCUMENTS

| | | | |
|---|---|---|---|
| 3,255,571 | 6/1966 | Walker et al. | 204/188 |
| 3,574,085 | 6/1971 | Woelflin | 204/302 |
| 4,049,535 | 9/1977 | Winslow et al. | 204/305 |
| 4,252,631 | 2/1981 | Hovarongkura et al. | 204/188 |
| 4,329,159 | 5/1982 | Bull | 204/188 |
| 4,919,777 | 4/1990 | Bull | 204/188 |

*Primary Examiner*—John Niebling
*Assistant Examiner*—Kishor Mayekar
*Attorney, Agent, or Firm*—James G. O'Neill

[57] ABSTRACT

A treater for electrostatically separating entrained saltwater from oil during longitudinal flow through a horizontally elongate metal tank, wherein the gas vapor and freewater are separated by gravity separation. Foam is eliminated by passing the gas vapor through an oil wash and coalescing of the entrained saltwater droplets is accomplished by flowing the emulsified oil downward through an electric field. The force of the downward flow through the electric field sweeps the coalesced saltwater drops from the electric field. The oil containing the coalesced water drops flows horizontally from the electric field rearward in the treater for gravity separation of the coalesced saltwater drops from the oil. Saltwater free oil, gas vapor and saltwater are discharged separately from the treater.

4 Claims, 1 Drawing Sheet

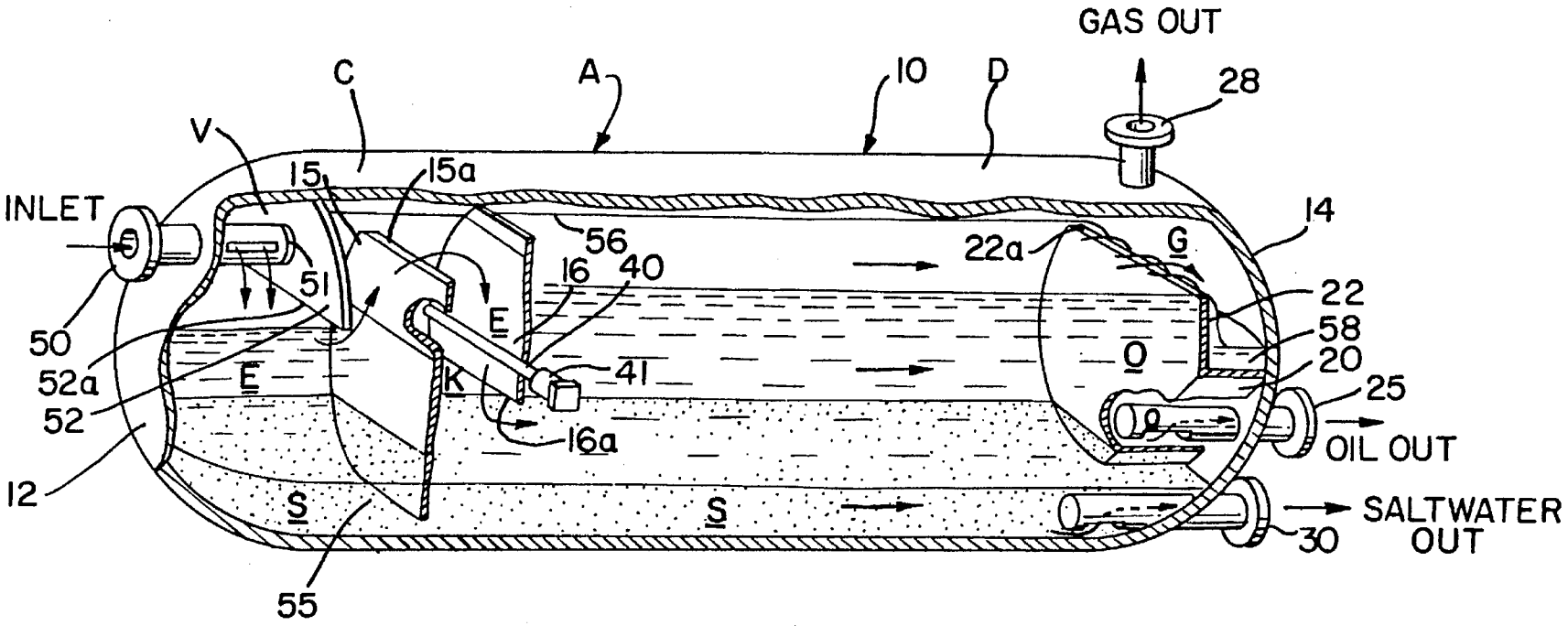
GAS OUT
28
14
22
58
20
25
OIL OUT
SALTWATER OUT
30
G
O
22a
D
10
A
56
40
41
16
16a
E
K
15a
C
15
51
V
E
S
S
55
INLET
50
52a
52
12

ELECTROSTATIC OIL EMULSION TREATING METHOD AND APPARATUS

BACKGROUND - FIELD OF INVENTION

This invention relates to the removal of salt water from oil through the use of an electric field to cause coalescence of small water drops into larger drops to speed up the gravity separation process.

BACKGROUND - DESCRIPTION OF PRIOR ART

The use of an electric field to increase the coalescing rate in two phase systems where the continuous phase has a low conductivity is a well known and widely used principle in the petroleum refining industry. The process is generally employed when it is necessary to reduce the salt content of the oil before progressing with the refining process.

The salt is dissolved in water droplets entrained in the oil. Separating the water from the oil will eliminate the salt from the oil. Enlarging the water drop size speeds up the separation. Passing the oil with the entrained water through an electrical field will cause the small water drops to rapidly coalesce into larger water drops.

The electrostatic coalescing unit consists of a vessel in which are arranged electrodes at least one of which is grounded to the vessel while at least one other is suspended by insulators, and an electrical system through which an electrical potential is applied to the suspended electrode. The most widely accepted arrangement of the electrodes is one above the other with the oil flowing upward through the electric field.

A persistent problem related to that type of apparatus has been the accumulation of water drops suspended between the electrodes which will create a short circuit of the electric flow between the electrodes.

Two common means have been employed to overcome the problem of this type of electrical short circuiting. One means is to enlarge the cross sectional dimensions of the area of the electric field to reduce the flow velocity through the electric field and thereby reduce the resistance to the water droplets descending from the coalescing area. Another means is to incorporate a reactive transformer by which the voltage is automatically reduced as the electric current increases.

Enlarging the cross sectional area of the electric field requires a larger and more expensive containment vessel.

Utilizing the reactive transformer reduces the voltage output which in turn negates the high potential energy needed for effective rapid coalescence of the water droplets.

Employing either or both of the above means to remedy the problem of water accumulation and short circuiting of the electrical current in the electric field increases equipment cost and energy consumption.

OBJECTS AND ADVANTAGES

Accordingly besides the objects and advantages of the electrostatic coalescing means described by the above patent some objects and advantages of the present invention are:

a. to provide an electrostatic oil emulsion treating means that will require a smaller cross sectional area of the electrical field and like wise a smaller and less expensive containment vessel.

b. to provide an electrostatic oil emulsion treating means wherein the electric field will be purged of the coalesced water droplets thereby preventing the short circuiting of the electric flow between the electrodes.

Further objects and advantages are to provide an electrostatic oil emulsion treating means that will require less power consumption due to the dispersion of the high potential energy into a less conductive atmosphere and will require smaller and less expensive transformers and smaller and less expensive electrodes. Still further objects and advantages will become apparent from a consideration of the ensuing description and drawing.

BRIEF DESCRIPTION OF THE DRAWING

FIG. 1 is a perspective view of the preferred embodiment apparatus of the invention with a longitudinal portion thereof cut away to illustrate the interior of the apparatus.

DESCRIPTION OF THE PREFERRED EMBODIMENT

Referring to FIG. 1 and apparatus A there is disclosed the method by which the present invention may be carried out to effect separation of a oil emulsion E into the respective components thereof, namely, saltwater S, gas G and saltwater free oil O.

The apparatus A of FIG. 1 depicts a free water separation and gas separation compartment and downstream coalescing and separation compartment with an elongated cylindrical metal tank 10 having a first end 12 and a second end 14. An electrically grounded metal bulkhead 15 separates the tank 10 into the two functional compartments, these being the freewater separation and gas removal compartment depicted at C in FIG. 1 and the coalescing and separation compartment D. An additional electrically grounded metal bulk head 16 isolates an area K within compartment D wherein the electric field will reside.

At the far end 14 of the tank 10 an angularly disposed baffle 20 extends inwardly into tank 10 and is connected at its inner edge to a vertical transverse bulkhead 22 having an upper horizontal edge **22*a*. The bulkhead 22 acts as a weir and the height of the upper edge 22*a* establishes the depth of the oil emusion E throughout the apparatus. Baffle 20, bulkhead 22 and the interior surface of tank 10 adjacent to the end 14 cooperate to define a reservoir 58 into which saltwater free oil O is discharged for withdrawal through clean oil outlet 25. A gas outlet 28 is located in the top of tank 10 near the end 14 and a salt water outlet 30 is located in the end 14 near the bottom of tank 10**.

A high voltage electrode 40 is located transverse to the oil emulsion flow path in the coalescing and separation compartment D of tank 10 in an area partitioned off by the electrically grounded metal bulkheads 15 and 16. The high voltage electrode 40 is isolated from the metal wall of tank 10 by a conventional electrical insulating bushing 41. An electrical current supplying transformer (not shown) supplies high voltage AC or DC power to the electrode 40 establishing a high potential energy field with current flowing between the high voltage electrode 40 and the electrically grounded metal bulk heads 15 and 16.

The oil emulsion inlet 50 is located in the free water separation and gas separation compartment C on tank end 12 near the top of tank 10. A conduit 51 with slotted openings extends into tank 10 abutting a transverse baffle 52 which is sealed to the upper interior wall surface of tank 10 and extends vertically downward having a horizontal lower edge **52*a*** with serrations that penetrates the upper surface of the crude oil emulsion E.

The upper edge 15*a* of the electrically grounded metal bulkhead 15 is located somewhat below the upper surface of the oil emulsion. The lower edge of 15 is only slightly above the bottom interior wall surface of tank 10 this permits the oil emulsion E to flow over the upper edge 15*a* of the electrically grounded metal bulkhead 15 and the separated free water to flow under the lower edge of 15 through opening 55. The upper edge of electrically grounded metal bulkhead 16 extends above the top surface of the oil emulsion E. The lower edge 16*a* of electrically grounded metal bulkhead 16 is above the lower surface of the oil emulsion E therefore the oil emulsion E is prohibited from flowing over the top of the electrically grounded metal bulkhead 16 but instead the oil emulsion E must flow downward through electrically charged space K exiting space K by flowing under the lower edge 16*a* of the electrically grounded metal bulkhead 16. The advantage of moving the oil emulsion downward between the electrically grounded metal bulkheads 15 and 16 will become apparent through a detailed description of flow through the apparatus A.

Referring to FIG. 1 oil emulsion E is delivered continuously into the freewater separation and gas separation compartment C through the inlet 50. The oil emulsion E enters compartment C through slotted openings in conduit 51. Gas vapor will fill the space V inside an upper portion of compartment C as defined by transverse baffle 52 in cooperation with the interior surface of tank 10 and the interior surface of tank end 12. This space V acts as a plenum wherein the initial gas separation will take place. To exit space V the gas vapor must suppress the upper surface of the oil emulsion forward of the transverse baffle 52 which has its lower edge 52*a* penetrating the upper surface of the oil emulsion. This action of slightly increasing the pressure of the gas vapor and then passing the gas vapor through an oil emulsion wash will act to break the foam which if allowed to skim over the upper surface of the oil emulsion E could carry with it sufficient water content to disrupt the treating process within the apparatus A. Once the gas is separated from the oil emulsion E the free water will separate and settle to the bottom portion of compartment C exiting compartment C by passing through a opening 55 located at the bottom edge of electrically grounded metal bulkhead 15. The oil emulsion E from which the free water has been separated flows over the upper edge 15*a* of electrically grounded metal bulkhead 15 to enter the space K which is defined by electrically grounded metal bulkheads 15 and 16 in cooperation with the adjacent interior wall surface of tank 10. Within the space K a high potential energy electric field exists due to the flow of electric current between the electrically grounded metal bulkheads 15 and 16 and the high voltage electrode 40. The oil emulsion E flows down through space K exiting under the bottom edge 16*a* of electrically grounded metal bulkhead 16. Small saltwater drops entrained in the oil emulsion E are rapidly coalesced into larger saltwater drops as the oil emulsion flows down through the high potential energy electric field. The downward flow of the oil emulsion E sweeps the coalesced salt water droplets from the electrically charged space K thereby preventing short circuiting of the electric current that would result if the coalesced water droplets were permitted to reside and accumulate within the electric field.

The salt water drops enlarged by electrostatic coalescence will rapidly separate from the oil in the rearward area of compartment D of tank 10. The coalesced and separated saltwater will combine with the separated freewater flowing along the lower portion of tank 10 to exit through the saltwater outlet 30. The gas vapor exits compartment C through an opening 56 at the upper edge of electrically grounded metal bulkhead 16 to flow along the upper portion of tank 10 and exit the tank 10 through the gas outlet 28.

In operation, it will be recognized that the apparatus described will maintain a gas vapor - oil emulsion interface in the upper level of the tank and a saltwater-oil emulsion interface at the predetermined level in the lower portion of the tank, thereby inducing uniform operation of the apparatus for uniform feed conditions.

From the foregoing it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and subcombinations. This is contemplated by and is within the scope of the claims. Although the foregoing invention has been described in some detail by way of illustration and example for purposes of clarity of understanding, it will be obvious that certain changes and modifications may be practised within the scope of the appended claims.

What is claimed is:

1. In an apparatus for separating an emulsion of gas vapor, oil and saltwater into its components including a substantially horizontally elongate metal tank having an interior with a top and a bottom and constructed and arranged for flow of fluids therethrough from an upstream fluid inlet to downstream outlets for gas vapor, oil and saltwater, the combination of:

a plurality of bulkheads defining a first, upstream gas vapor separation and freewater separation compartment and a second, downstream coalescing and freewater separation compartment;

an inlet conduit having an inlet end and an outlet end fluidly connected to the interior of said substantially horizontally elongate metal tank in said first, upstream gas vapor separation and freewater separation compartment, adjacent to the top of said interior of said substantially horizontally elongate metal tank; said inlet conduit being capped at said outlet end and having slotted openings for dispersion and distribution of said oil emulsion into said interior of said substantially horizontally elongate metal tank;

a baffle means mounted in said first, upstream gas vapor separation and freewater separation compartment, for entrapping the gas vapor in the top of said interior of said substantially horizontally elongate metal tank in a manner so as to cause said gas vapor so trapped to pass through a liquid column of said emulsion into said second, downstream coalescing and saltwater separation compartment;

electrostatic field means disposed within said second, downstream coalescing and freewater separation compartment; said electrostatic field means partitioned in such a manner that said oil emulsion flows downwardly through the electrostatic field, toward the bottom of said interior of said substantially horizontally elongate metal tank, causing said water droplets entrained in said oil emulsion to coalescence into larger water drops; and an area located in said second, downstream coalescing and freewater separation compartment in which the oil emulsion containing the coalesced larger water drops can reside to effect separation of said coalesced larger water drops from the oil.

2. The separation apparatus of claim 1 wherein AC power is provided to form the electrostatic field within said interior of said generally horizontal elongate metal tank.

3. The separation apparatus of claim 1 wherein DC power is provided to form the high energy potential electric field within said interior of said generally horizontal elongate metal tank.

4. In an apparatus for separating an oil emulsion containing a mixture of gas vapor, oil and saltwater into its components, including a generally horizontal elongate metal tank having an interior with a top and a bottom and constructed and arranged for a substantially longitudinal flow therethrough from an upstream fluid inlet to separate downstream outlets for gas vapor, oil and saltwater, the combination of:

a first means for separating gas vapor and free saltwater from the mixture;

a second means, disposed downstream from the fluid inlet and away from said first means, for applying high potential electric energy to said oil emulsion so as to cause the coalescence of drops of saltwater in said oil emulsion into larger drops; said second means being configured so as to cause said oil emulsion to flow in a downward direction, from said top toward said bottom of said interior, as said high potential electrical energy is applied;

a third means disposed downstream of said second means to permit the larger drops of salt water to separate from the oil; and said generally horizontal elongate metal tank having an inlet and separate downstream gas vapor, oil and saltwater outlets, fluidly connected to said interior; a plurality of bulkheads defining a first, upstream gas vapor separation and free saltwater separation compartment and a second, downstream coalescing and saltwater separation compartment; fluid distribution and diffusion means disposed in said first upstream compartment including a gas entrapment means for entrapping gas vapor in such a manner as to cause a slight increase in pressure of said entrapped gas vapor and to cause said entrapped gas vapor flowed though a portion of said oil emulsion into said second, downstream coalescing and saltwater separation compartment; a high voltage electrode positioned transverse to said flow of said oil emulsion along said generally horizontal elongate metal tank from said inlet to said outlets, between a pair of electrically grounded metal bulkheads, in said second, downstream coalescing and saltwater separation compartment; said pair of electrically grounded metal bulkheads causing said oil emulsion to flow in a downward direction, from said top toward said bottom of said interior, as said oil emulsion receives said electric charge.

* * * * *

UNITED STATES PATENT AND TRADEMARK OFFICE

CERTIFICATE OF CORRECTION

PATENT NO. : 5,464,522

DATED : November 7, 1995

INVENTOR(S) : Jerry M. Edmondson

It is certified that error appears in the above-indentified patent and that said Letters Patent is hereby corrected as shown below:

On the cover sheet, in the second line opposite "[45] Date of Patent" correct the inventor's last name so that it reads -- Edmondson --, and on line "[76] Inventor", please change the inventor's name to read as follows:

-- Jerry M. Edmondson --.

Signed and Sealed this

Fourteenth Day of May, 1996

*Attest:*

*Attesting Officer*

BRUCE LEHMAN

*Commissioner of Patents and Trademarks*